United States Patent [19]

Summers et al.

[11] Patent Number: 4,788,844

[45] Date of Patent: Dec. 6, 1988

[54] APPARATUS FOR STRAIGHTENING SLENDER SHAFTS

[75] Inventors: Donald L. Summers, Glendale Heights; David J. Summers, Hanover Park; John G. Tolomei, Coal Valley, all of Ill.

[73] Assignee: Inventive Enterprises Inc., West Chicago, Ill.

[21] Appl. No.: 44,766

[22] Filed: May 1, 1987

[51] Int. Cl.[4] ..... B21D 3/02

[52] U.S. Cl. ..... 72/110; 72/211; 140/147

[58] Field of Search ..... 140/147; 72/110, 111, 72/95, 80, 98, 210, 211

[56] References Cited

U.S. PATENT DOCUMENTS

| | | | |
|---|---|---|---|
| 202,978 | 4/1878 | Atwood | 72/111 |
| 2,056,155 | 10/1936 | Brinkman | 72/110 |

FOREIGN PATENT DOCUMENTS

| | | | |
|---|---|---|---|
| 944318 | 12/1963 | United Kingdom | 72/110 |
| 1231685 | 5/1971 | United Kingdom | 72/110 |

*Primary Examiner*—Lowell A. Larson

[57] ABSTRACT

An apparatus for straightens long slender shafts by moving a force couple over the length of the shaft as the shaft is rotated. The force couple is applied by two or more contact points with at least two contact points being located on opposite sides of the shaft. The contact points are mounted on a movable base. A pair of parallel guide rods receive the base and restrain the base against movement in a direction perpendicular to the axis of the shaft. A lever, pivotally mounted to the base, holds one of the contact points. Movement of the lever controls the magnitude of the force couple and movement of the base relative to the shafts. The lever can be manually operated to lend simplicity to the apparatus.

14 Claims, 1 Drawing Sheet

APPARATUS FOR STRAIGHTENING SLENDER SHAFTS

BACKGROUND OF THE INVENTION

1. Field of the Invention

This invention relates generally to an apparatus for realigning cylindrical members. More specifically this invention relates to a semi-automatic machine for removing axial bends and kinks from long slender shafts.

2. Description of the Prior Art

It is generally known that long, slender, cylindrical members can be straightened by moving a force couple down the length of the shaft as it rotates. The magnitude of the force couple required to effect straightening varies with the stiffness of the shaft and the speed of shaft rotation. Therefore these techniques are employed primarily by skilled machinists or those knowledgeable in the field of metal working. This technique can be used for hollow or solid shafts. One application of long, straight, slender shafts is in the meat processing industry.

In the meat processing industry it has become common practice to process meat by the injection of curing fluids. A wide variety of meat cuts such as chicken, ham and beef are injected with these fluids to preserve the meat while also improving flavor and texture. In order to inject these fluids into the meat an array of long hollow shafts, or needles, which make up part of an injector machine, pierce the meat undergoing treatment and discharge the treating fluid as they pass through the meat.

Occasionally a needle will encounter an obstruction, such as bone or other relatively hard material, which bends the needle as it is pushed into the meat. Bends in the needles disrupt the pattern of the needle array. This results in an uneven distribution of the treating fluid. Such uneven or maldistribution can leave portions of the meat untreated. When the needles are bent too severely they interfere with the operation of the injector machine. Therefore it is important that misalignment of the needles be corrected.

Since these injection needles are relatively expensive, it is common practice to realign or straighten the needles whenever possible. Current practice for realigning the needles is to straighten them by hand using a vice and a pliers. This technique is time consuming and increases the cost of operating an injection machine.

It is an object of this invention to provide a simple apparatus for straightening long slender shafts.

It is a further object of this invention to provide an apparatus for straightening long slender shafts that is easy to operate.

A more specific object of this invention is to provide a relatively inexpensive apparatus for straightening injection needles.

BRIEF DESCRIPTION OF THE INVENTION

In a broad embodiment this invention is an apparatus for straightening a slender cylindrical member. The apparatus comprises means for rotating the cylindrical member about its longitudinal axis, means for putting a force couple about the longitudinal axis of the cylindrical member, and means for moving the force couple over the length of the cylindrical member as the cylindrical member rotates about its longitudinal axis.

In a more limited embodiment this invention is an apparatus for straightening a slender shaft that comprises means for rotating the shaft about its longitudinal axis while a force couple moves down the axis of rotation. The force couple of this embodiment is applied using two opposing contact points, located on opposite sides of the shaft and separated by a relatively small distance, that move down the shaft as it rotates. A movable base supports the contact points. Means associated with the base urge the contact points against opposite sides of the shaft while simultaneously moving the base along the length of the shaft.

A yet more limited aspect of this invention uses a hand controlled lever as the means associated with the base. The lever controls both the movement of the base and the pressure generated by the contact points.

Other embodiments, aspects, and details of this invention will become apparent from the following detailed description.

DETAILED DESCRIPTION OF THE INVENTION

This invention is described in the limited context of a single preferred embodiment. The embodiment is an apparatus for straightening thin hollow shafts that comprise injection needles. Description of this invention in the context of a preferred embodiment is not meant to limit the invention to the details disclosed herein.

Figure 1:
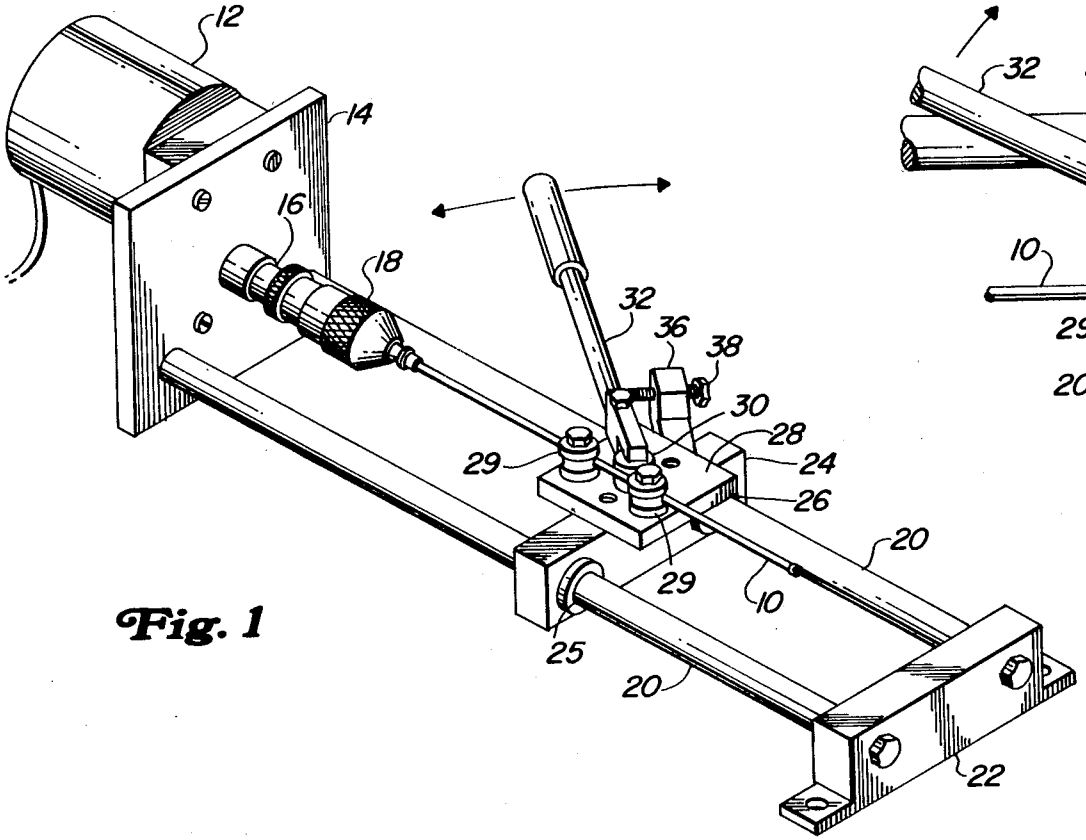
FIG. 1 is a perspective view of the apparatus of this invention.

Looking then at FIG. 1, the total apparatus for straightening needles is displayed. The apparatus consists primarily of means for rotating a shaft comprising a needle 10 about its longitudinal axis, means for putting a force couple about the longitudinal axis of the needle and means for moving the force couple over the length of the needle. A typical needle that will be straightened in the device of FIG. 1 will be made of ductile material such as stainless steel and have an outside diameter of approximately 3/16 to 5/16 inches and a wall thickness of about 1/16 of an inch. In order to prevent collapsing of the needle during the straightening process it should have a maximum diameter to wall thickness ration 10.

Means for rotating the needle comprises a motor 12, secured to a back plate 14, having a driving relationship to a shaft 16. Shaft 16 has a chuck 18 attached to one end for receiving and retaining needle 10. Preferably needle 10 rotates at between 400 to 1000 rpm. Motor 12 must provide sufficient torque to rotate the needle against the herein described force couple and maintain the desired rotational velocity. For typical needles a motor having $\frac{1}{8}$ to $\frac{1}{4}$ horsepower can supply the required torque. Motor 12 operates at 1760 rpm and drives shaft 16 through a set of pulleys (not shown) that reduce the shaft speed to approximately 600 rpm. Although FIG. 1 shows motor 12 offset form shaft 16 the chuck 18 can be directly coupled to a motor having a suitable output rpm and horsepower.

Below chuck 18 a pair of parallel guide rods 20 extend from back plate 14. Plate 14 holds the back end of the guide rods while a front mounting 22 fixes the guide rods in a parallel relationship. Guide rods 20 also extend parallel to the straightened axis of needle 10. A relatively large perpendicular clearance is provided between the needle 10 and guide rods 20 so that the end of a severely bent needle does not contact the guide rods when it is initially rotated during the straightening process.

Guide rods 20 support a shuttle 24 which provides a movable base for carrying the remainder of the straightening apparatus. Each of rods 20 pass through an opening 25, 26 in shuttle 24. A pair of linear bearings at the front and back of each opening ( not shown) contact the rod passing therethrough so that the shuttle moves freely on the rods while maintaining a perpendicular alignment relative thereto. A plate 28 mounted atop shuttle 24 holds a set of spools that provide contact points for applying the force couple to needle 10. Spools 29 are bolted to the top of plate 26 in a stationary position relative thereto. A third contact point is provided by spool 30 which depends from a pivotally mounted handle 32 and is positioned along the length of needle 10 at a location intermediate spools 29. Clockwise rotation of handle 32 about an attachment bolt 34, which acts as a fulcrum, urges spool 30 into needle 10. Spools 29 counteract the force of spool 30 against needle 10 and in so doing creates a force couple about the needle in the region between the spools. A restraining bracket 36 holds an adjustment bolt 38 for controlling the magnitude of the force couple. The distal end of bolt 38 contacts handle 32 to limit rotation of the handle and the resulting pressure of spool 30. Indexing bolt 38 inward or outward sets the maximum limit for the force couple. Urging handle 32 in a clockwise direction also moves shuttle 24 away from chuck 18 and the spools 29 and 30 down the length of the needle.

Figure 2:
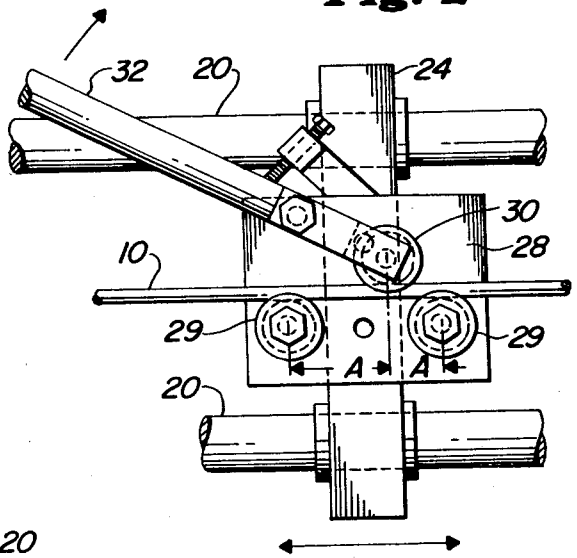
FIG. 2 is a partial plan view of FIG. 1.

FIG. 2 shows the arrangement of the shuttle 24, plate 28, spools 29,30, and handle 32 in further detail. Ideally needle 10, when straight, will rest against spools 29. Preferably the distance between either of spools 29 and spool 30, taken along the axis of the needle and shown as dimension A, is minimized in order to concentrate the force couple over a small section of the needle and thereby improve the overall straightening effectiveness of the apparatus. For this purpose dimension A should not exceed 10 needle diameters. For clearance reasons dimension A will usually be a least one needle diameter.

Figure 3:
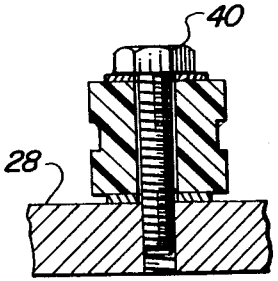
FIG. 3 is a cross section view of a portion of FIG. 2.

The configuration and method of attaching spools 29 to plate 28 is depicted in FIG. 3. A bolt 40 passes through the center of spool 29 and fastens the spool to plate 28. A concave notch comprising a groove 42 circles the middle of spool 29. This groove traps the needle and prevents it from moving over the face of the spool during application of the force couple. Grooves of this type may be provided on all of the spools or only the spools located to one side of the needle. Preferably the groove will have a width equal to or greater than the diameter of the needle. In preferred form the notch has a square configuration, but can also have a semi- circle or V shape.

Movement of handle 32 applies the force couple to the needle and moves the contact points of spools 29 and 30 down the length of the needle. As a result the apparatus of this invention is operated by the movement of a single lever comprising handle 32. A complete operating procedure for the apparatus would begin with the insertion and tightening of a needle in chuck 18. Before starting motor 12, and the rotation of needle 10, handle 32 is rotated counterclockwise to move spool 30 away form the needle and shuttle 24 is to chuck 18. Once the needle begins rotating, clockwise rotation of the handle imposes the force couple on the needle as the shuttle is moved down its length. Upon reaching the end of the needle, handle 32 is again rotated counterclockwise to return the shuttle and begin another pass down the needle. A severely bent needle may require several passes of the spools along its length to obtain the desired degree of straightening.

As the needle rotates and the spools are moved down the length of shaft friction between the needle and spools resist both types of movement. The spool material is selected to minimize this friction while also resisting the heat and wear associated therewith. Thus the spools should be made of relatively hard materials having self lubricating properties. Suitable materials include teflon, leather and engineered plastics. A particularly preferred material is a type 6/6 nylon material compounded with lubricants. One such material is sold by the Polymer Corporation under the trademark Nylotron. In an effort to reduce friction the spools can be pivotally mounted to rotate as they move down the shaft thereby eliminating the friction associated with this type of movement. The spool detail of FIG. 3 is readily modified to achieve such a function.

We claim:

1. An apparatus for straightening a slender cylindrical member, said apparatus comprising:

(a) means for rotating said cylindrical member about its longitudinal axis;

(b) at least two opposing contact points located on opposite sides of said member and separated along the length of the member;

(c) a movable base for supporting said contact points; and (d) means for moving said base and contact points along the axis of said cylindrical member and urging at least one of said contact points against said cylindrical member to create a force couple about said member by the application of a single force, said force having at least a component in a direction parallel to the longitudinal axis of said shaft.

2. The apparatus of claim 1 wherein said means for rotation rotates said cylindrical member at a speed of from 400 to 1000 revolutions per minute.

3. The apparatus of claim 1 wherein said contact points are made of a type 6/6 nylon material that is compounded with lubricant additives.

4. The apparatus of claim 1 wherein said contact points each have a concave surface for contacting and trapping said shaft.

5. The apparatus of claim 1 wherein a total of three contact points can act against said shaft, one of said contact points being located intermediate to and on an opposite side of said shaft from the other two contact points.

6. The apparatus of claim 1 wherein said means for moving said base and urging said contact points is a single lever supported by said base for pivotable movement in a plane containing all of said contact points and having coupled to at least one of said contact points fixed thereto.

7. An apparatus for straightening a slender shaft having a hollow interior, said apparatus comprising:

(a) a motor for rotating said shaft about its longitudinal axis at an angular velocity of from 400 to 1000 revolutions per minute and means for securing said shaft to said motor;

(b) a set of at least two guide rods extending in a direction parallel to the longitudinal axis of said shaft and fixed with respect to said motor;

(c) a movable base slidably mounted to said rods and restrained against movement in a direction perpendicular to the longitudinal axis of said rods;

(d) at least two contact points, fixed with respect to said base, and located on opposite sides of said shaft; and (e) a lever for simultaneously urging at least one of said contact points against said shaft and moving said contact points along said shaft, said lever being pivotally mounted on said base for pivotal movement in a plane parallel to a plane containing said rods, and having one of said contact points fixed thereto.

8. The apparatus of claim 7 wherein said base supports two contact points on a side of said shaft opposite said lever supported contact point.

9. The apparatus of claim 8 wherein said contact points have a concave surface for contacting and trapping said shaft.

10. The apparatus of claim 9 wherein said concave surface comprises a square notch having a width equal to or greater than the diameter of said shaft.

11. The apparatus of claim 10 wherein said contact points are made of a type 6/6 nylon material that is compounded with lubricant additives.

12. The apparatus of claim 8 wherein said rods are round and said base is slidably mounted to said rods by sets of linear bearings that surround each rod.

13. The apparatus of claim 8 wherein the contact point supported by said lever is intermediate the two contact points located on the opposite side of said shaft and said two contact points located on the opposite side of said shaft are separated by less than ten diameters of said shaft.

14. The apparatus of claim 7 wherein said shafts comprise injection needles for adding fluids to meat products.

* * * * *